United States Patent [19]

Lyles

[11] Patent Number: 4,517,995

[45] Date of Patent: May 21, 1985

[54] FILTERS FOR POLYNUCLEAR AROMATIC HYDROCARBON-CONTAINING SMOKE

[76] Inventor: Mark B. Lyles, 1700 S. Third St., Louisville, Ky. 40208

[21] Appl. No.: 314,424

[22] Filed: Oct. 23, 1981

[51] Int. Cl.[3] ..... A24D 3/08; A24D 3/10; A24D 3/12; A24D 3/14

[52] U.S. Cl. ..... 131/334; 131/339; 131/342; 55/389

[58] Field of Search ..... 131/336, 339, 334, 341, 131/342, 343, 344, 345; 55/389; 252/426

[56] References Cited

U.S. PATENT DOCUMENTS

T901,024 8/1972 Sloan ..... 131/334

OTHER PUBLICATIONS

"Fluorescence of 1,3,7,9-Tetramethyluric Acid Complexes of Aromatic Hydrocarbons" by Van Duuren, The Journal of Physical Chemistry, Mar. 31, 1964.

*Primary Examiner*—V. Millin

*Attorney, Agent, or Firm*—King, Liles and Schickli

[57] ABSTRACT

The present invention provides a filter for a polynuclear aromatic hydrocarbon containing smoke. In one embodiment, the filter is used in combination with an exhaust system of an internal combustion engine or in combination with an industrial smoke stack. In this embodiment, the filter includes a filtering material and a PAH-reducing amount of at least one purine. In another embodiment, the filter includes a filtering material of a certain type and a PAH-reducing amount of at least one purine. In a related embodiment, the filter includes a filtering material and a PAH-reducing amount of at least one purine free from tannic acid contamination. In each instance, the purine is distributed on the surface of the filtering material.

44 Claims, 5 Drawing Figures

FILTERS FOR POLYNUCLEAR AROMATIC HYDROCARBON-CONTAINING SMOKE

TECHNICAL FIELD

This invention relates to the field of smoke purification. More specifically, it is related to filters for substantially eliminating or at least reducing the amount of polynuclear aromatic hydrocarbons in a polynuclear aromatic hydrocarbon-containing gas or smoke, particularly cigarette and other tobacco smoke.

BACKGROUND ART

It is generally thought that the carcinogens in tobacco smoke are primarily polynuclear aromatic hydrocarbons (PAHs), with benzo(a)pyrene and dibenzanthracene being particularly recognized examples. In fact, these two compounds are among the most carcinogenic substances found in tobacco smoke. Filters for removing PAHs from tobacco smoke have been proposed, and are exemplified by U.S. Pat. No. 3,828,801 to Merrill and U.S. Pat. No. 4,038,992 to Ogasa et al, the disclosures of which are incorporated herein by reference. However, this type of prior art proposes filters that would appear to be either expensive to produce or to lack selectivity for PAHs. The Ogasa et al patent uses, inter alia, a granular composition that is a blend of protein powder and active charcoal granules, whereas the Merrill patent proposes polysiloxane compositions mixed with the tobacco and/or employed in a filter.

There have been proposed in the prior art tobacco smoke filters containing additives such as coffee or tea for various stated purposes. U.S. Pat. No. 253,296 to Kinney, U.S. Pat. No. 2,172,946 to Sutter and U.S. Pat. No. 3,319,630 to Orrmins are illustrative. Coffee and tea contain caffeine, a purine, as well as a number of other organic compounds such as tannic acid. In the Kinney patent, cotton or other like filamentous material is saturated with a paste of one or more additive substances "having chemical properties which cause it to take up, neutralize, or destroy the nicotine, thus purifying the smoke and rendering it innoxious and pleasant," or if the additive substance is granulated, the filter may be made of a proper quantity of the additive substance united together by a suitable cement or gum. Examples of additive substances are given as charcoal, tea, coffee, benzoic acid, arsenic of soda, lichen from Iceland, and balsam of toln. The Sutter patent proposes ground or shredded roasted coffee or tea or an extract thereof as the sole or principal element in an absorbent and purifying composition that is used to "depoison" tobacco smoke. Sutter's stated purpose is to neutralize, paralyze or render harmless the noxious gases contained in tobacco smoke and to filter out certain other products of combustion, and he states that the caffeine or theine of roasted coffee or tea neutralizes the acid gases in the smoke, while the tannic acid neutralizes the alkaloid gases. The Orrmins patent relates to a tobacco smoke filter that contains a filter pack of dehydrated coffee or tea extract, which is said to have a high percentage content of concentrated and free tannin or tannic acid to neutralize the nicotine carried by tobacco smoke. In this type of prior art, there was and is no recognition that a purine such as caffeine will form a complex with and thereby selectively remove from tobacco smoke highly carcinogenic PAHs, or that a purine exerts a remarkably increased PAH-removing effect when used in combination with a filtering material having a particular capability for the removal of a certain amount of the total particulate matter (TPM) from smoke. This particular capability is discussed in detail below. Furthermore, to the extent that caffeine would be present in these proposed arrangements, it would be bound, complexed or masked as a minor constituent of coffee or tea, rather than free and uncomplexed caffeine. As such, it is believed that the caffeine would be masked by the other coffee constituents such that there would be very limited contact of the smoke with any caffeine present. Additional prior art similar to the three patents just discussed is Wynder and Hoffmann, "Tobacco and Tobacco Smoke," Academic Press, 1967, which mentions the use of roasted coffee granules and of tea leaves as a filter material for tobacco smoke at page 564 thereof. Also known in the prior art is the use of coffee and cocoa as tobacco blend additives. Exemplary of this type of prior art are U.S. Pat. No. 250,740 to Lawrence, and U.S. Pat. No. 1,927,984 to Krensky et al.

Research has shown that there is a selectively enhanced solubility of aromatic hydrocarbons such as the PAHs in aqueous solutions of purines such as caffeine. This type of prior art is illustrated by Brock et al, *Arch. Exptl. Pathol. Pharmokol.*, 189:709 (1938); Wanless et al, *Anal. Chem.*, 23:563 (1951); and Booth et al, *Biochem. Biophys. Acta.*, 12:75 (1953). Furthermore, studies have been made of the bonding forces between PAHs such as pyrene and a purine such as 1,3,7,9-tetramethyluric acid, as illustrated by De Santis et al, *Nature*, 191:900 (1961). In addition, the prior art has shown that the oral administration of benzo(a)pyrene in rats markedly increases the rate of plasma clearance of caffeine; and that caffeine and to a lesser extent theophylline inhibits the binding of dimethyl benz(a)anthracene to mouse epidermal cell DNA in culture. The binding of this PAH to DNA appears to be a prerequisite for the initiation of its bioactivity. Prior art of this type is exemplified by Welch et al, *Clin. Pharmacol. Ther.*, 22:791 (1977) and Shoyab, *Arch. Biochem. Biophys.*, 196:307 (1979). Moreover, it has been shown that caffeine inhibits the carcinogenic action of cigarette smoke condensate fractions when added to the fractions prior to application on mouse skin. This type of art is illustrated by Rothwell, *Nature*, 252:69 (1974).

I am aware of no prior art or earlier work which discloses or suggests the remarkable capabilities of a purine-containing filter, especially a caffeine-containing particular filter, in removing PAH carcinogens from smoke, especially tobacco smoke.

OBJECTS AND SUMMARY OF THE INVENTION

It is accordingly one object of the present invention to provide a filter for a PAH-containing smoke that contains a material that selectively complexes with PAHs and thereby provides removal thereof from smoke.

A further object of the present invention is to provide a filter for a PAH-containing smoke that contains an inexpensive and readily available additive compound that serves to remove PAHs from the smoke.

A still further object is to provide a filter of the type just described that contains a filtering material having a filtration surface area and airflow characteristics that provide removal of at least about 40–45% of the total particulate matter from the smoke, which filter rather remarkably enhances the effect of the additive material.

An even further object is to provide a filter cigarette having such a filter.

An additional object is to provide a method for reducing the amount of PAHs in a PAH-containing smoke that involves using a filter in accordance with the present invention.

Another object is to provide a filter of the type described above in combination with a PAH-containing smoke emitter, such as an exhaust system of an internal combustion engine or an industrial smoke stack.

Other objects and advantages of the present invention will become apparent as the description thereof proceeds. One of these additional advantages is that the present invention, particularly in the instance where caffeine is the compound utilized, takes advantage of a material common to a human habit for the purpose of reducing the impact of a hazardous substance encountered in another human habit.

In satisfaction of the foregoing objects and advantages, there is provided by this invention a filter for a PAH-containing smoke. In one embodiment, the filter is in combination with a mechanical or industrial or similar PAH emitter such as an exhaust system of an internal combustion engine or an industrial smoke stack. In this embodiment, the filter comprises a filtering material and a PAH-reducing amount of at least one purine, the purine being distributed on the surface of the filtering material. As a feature of this embodiment, there is provided a method for reducing the amount of PAHs in a PAH-containing smoke. This method comprises passing the smoke through the filter of this embodiment.

In a second embodiment of the present invention, the filter includes a filtering material having a filtration surface area and airflow characteristics that provide removal of at least about 40–45% of the total particulate matter from the smoke, and that includes a PAH-reducing amount of at least one purine. The purine is distributed on the surface of the filtering material. A closely related filter of the present invention includes a filtering material and a PAH-reducing amount of at least one purine free from tannic acid contamination, with the purine being distributed on the surface of the filtering material. Also by this invention, there is provided a filter cigarette having either of these filters, and there is provided a method for reducing the amount of PAHs in a PAH-containing smoke in which the smoke is passed through either of these filters.

It is preferred that the purine or purines are present in the filter either in substantially pure form, or at least not bound or complexed with, or masked by, other materials which would mask a substantial part of the purine from contact with the smoke or substantially reduce its complexation with, and removal of, PAHs from the smoke, such as would occur with caffeine in coffee or tea. As so present in a relatively high surface area cigarette filter, it is theoretically possible to remove substantially all PAHs or PAH-type compounds from the smoke. Suitable or optimum filter surface areas and air flow characteristics and amounts and distribution of the purine(s) will vary somewhat with tobacco blends, but those skilled in the art will be able to adapt appropriate combinations through experimentation in keeping with the concepts and guidance provided herein, so as to provide for removal of substantially all or a desired amount of PAH-type compounds, without destroying the physically and psychologically satisfying nature of the tobacco smoke.

BRIEF DESCRIPTION OF THE DRAWINGS

Reference is hereby made to the accompanying drawings which form a part of this specification.

BEST MODES FOR CARRYING OUT THE INVENTION

As discussed, the present invention is concerned with a filter for smoke containing PAHs. By the term "smoke" is meant the gaseous product of burning a carbonaceous material, usually made visible by the presence of small particles of carbon. Smoke containing PAHs results, for example, from the pyrolysis of tobacco and the combustion of fuel by an internal combustion engine, particularly a diesel engine. Industrially, certain pyrolysis process smokes contain PAHs.

Figure 1:
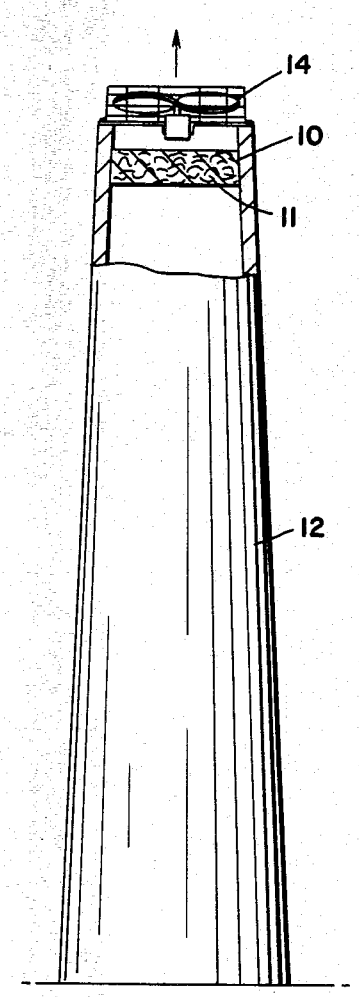
In FIGS. 1 and 2, the filter of the invention is illustrated in use on an internal combustion engine exhaust system and on an industrial smoke stack.
Figure 2:
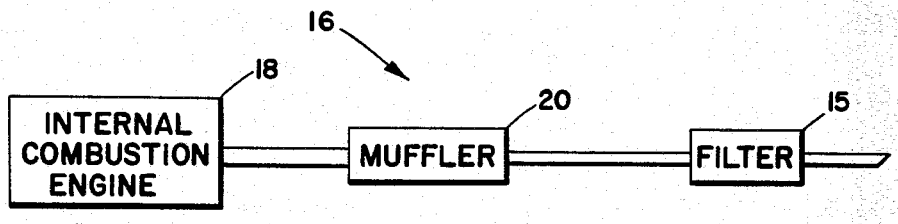

Broadly speaking then, in one embodiment of the present invention, a filter (15 or 10, respectively) is used in conjunction with an exhaust system of an internal combustion engine or in conjunction with an industrial smoke stack. The filter comprises a filtering material 11 and a purine that is distributed on the surface of the filtering material. Conveniently, when the filter is used on an industrial smoke stack, a fan or ejector may be employed in order to provide an adequate smoke flow through the smoke stack. In FIG. 1, filter 10 is shown in use on stack 12, and fan 14 is also shown. In FIG. 2, filter 15 is shown as part of an exhaust system 16 of an internal combustion engine 18. One suitable location of filter 10 in exhaust system 16 is shown in this figure, with it being understood that location of the filter on the other side of muffler 20 is also possible.

In this embodiment, the amount of purine that is used varies depending upon the size of the filter. Although not wishing to be bound by any theory, it is believed that a purine functions to remove PAHs from a smoke by formation of a complex with PAHs. Accordingly, it can be seen that the presence of even a small amount of a smoke-contacting purine on the surface of the filtering material exerts a PAH-reducing effect. As the life of a filter will be relatively longer with an increased amount of the purine present, the amount of the purine used in the filter can be selected so as to substantially cover the surface of the filtering material. Suitably, the amount of the purine used in the filter covers at least about 5% of the surface of the filtering material. It is preferred that the purine is substantially uniformly distributed on the surface of the filtering material.

The purine and the filtering material are described in more detail below. Optionally, the purine is a substantially pure chemical compound free from contaminants such as tannic acid. If contaminants are present, it is clearly preferred, from the standpoint of providing a filtered smoke of low hazard to life, that the contaminants are not themselves hazardous or do not decompose to form hazardous compounds as the smoke passes through the filter.

Figure 3:
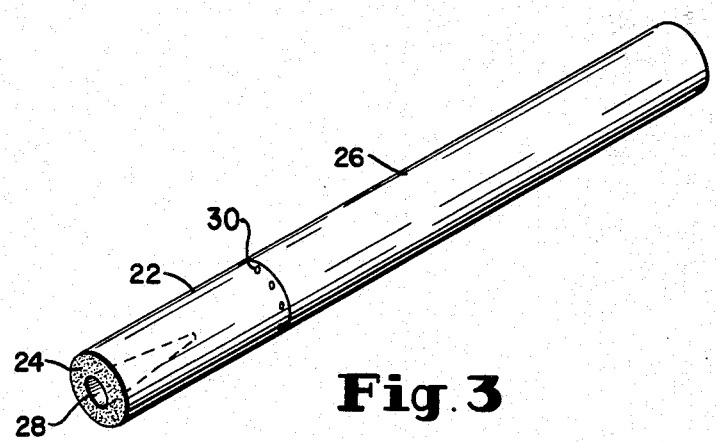
In FIG. 3, the filter is shown on a cigarette.

In the preferred embodiment of the filter of the present invention, the filter is primarily for the filtration of tobacco smoke. In FIG. 3, a filter 22 having a filtering material 24 is illustrated in use on a cigarette 26. This filter has a conical cavity 28, and a filter of this type is used in Example 2. The filter may also have the configuration of a conventional filter, as defined below.

In one aspect of this embodiment, the filter includes the filtering material and a purine free from contamination, e.g., as by tannic acid or any possible masking agent. The purine is distributed on the surface of the filtering material. As discussed with respect to the above embodiment, even a very small amount of the purine has the effect of reducing PAH content of the smoke. In this regard, the amount of the purine is conveniently at least about 0.1 milligrams. Suitably, as an upper limit, the purine is used in an amount that does not adversely affect the cigarette taste. Preferably, the purine is present in an amount sufficient to substantially eliminate the PAHs from the smoke passing through the filter. The purine may be present in an amount that is approximately equal, on a weight basis, to the tar present in the tobacco being smoked, or to the tar content of smoke passing through the filter of a filter cigarette according to measurement standards established by the United States Federal Trade Commission for the tobacco industry. It is preferred that the purine be substantially uniformly distributed on the surface of the filtering material. However, as discussed in more detail below, where the airflow characteristics of the filter are such as to provide for ventilation of fresh air into the filter as a result of which the effective filtration surface area is reduced because of channeling of the smoke to certain areas of the filter, it is preferred that the purine be substantially uniformly distributed over the effective filtration surface area of the filtering material.

Preferably, the filter contains a filtering material having a filtration surface area and airflow characteristics that in the normal untreated (no purine) state will provide removal of at least about 40–45% of the total particulate matter from the smoke passing through it, and it is especially preferable that the filtering material have a filtration surface area and airflow characteristics that provide removal of at least about 50% of the total particulate matter from the smoke, with about 60–95% removal being very preferred. The filtering material and the purine are discussed in greater detail below, and also provided below is further discussion of the meaning of the percentages for total particulate matter removal and factors such as filtration area that relate to total particulate matter removal.

In this embodiment of the filter of the present invention, the filter is primarily of a size and shape that permits use as a tobacco smoke filter. As a tobacco smoke filter, the filter is particularly useful as a cigarette filter, a filter in a cigarette or cigar holder, or a filter for a pipe.

In a second aspect of this embodiment of the filter of the present invention, the filter is comprised of a filtering material having a filtration surface area and airflow characteristics that provide removal of at least about 40–45% of the total particulate matter from the smoke. This filter is further comprised of a purine that is distributed on the surface of the filtering material. It is particularly suitable that the filtering material has a filtration surface area and airflow characteristics that provide removal of at least about 50% of the total particulate matter from the smoke, with about 60–95% removal being preferred. Preferably the purine is substantially uniformly distributed on the surface of the filtering material. However, when the airflow characteristics of the filter are such as to provide for ventilation of fresh air into the filter through apertures 30 as a result of which the effective filtration surface area is reduced, it is preferred that the purine be substantially uniformly distributed over the effective filtration surface area of the filtering material. The amount of the purine useful in this aspect of this embodiment of the invention is the same as that discussed above with respect to the previous aspect of this embodiment.

Presently, in the manufacture of some commercial cigarette filters in the United States, ventilation of fresh diluting air into the filters is provided. As a result of fresh air ventilation, smoke is channeled through only a portion of the available filtration surface area. Thus, the effective filtration area in filters of this type is less than the available filtration surface area. Accordingly, the airflow characteristics of a filter may include fresh air ventilation. Other ways to affect the available filtration surface area by varying airflow characteristics are known in the filter making art.

As explained above, a purine is contained in the filter of the present invention. Exemplary purines are 1,3,7,9-tetramethyluric acid (TMU), adenine, guanine, xanthine, hypoxanthine, caffeine, theophylline and theobromine. Each of these compounds has a purine ring structure. It is believed that a purine ring structure causes the formation of a complex with PAHs and that the purine-PAH complex remains in the filter as the smoke passes through the filter, as a result of which the PAH content of the smoke is reduced by the filter. Advantageously, the purine is a compound having a xanthine ring structure. Illustrative xanthines are xanthine, theophylline, theobromine and caffeine. Caffeine is an especially advantageous xanthine. It is within the scope of the present invention to use a mixture of two or more purines.

Selection of the filtering material is somewhat dependent upon the end use of the filter, that is, whether for filtration of tobacco smoke or of industrial process gases or other uses. Likely candidates for the filtering material are paper, cotton, cellulose, cellulose acetate and glass fiber, with mixtures being possible. When the filter is used as a tobacco smoke filter, the filtering material conveniently is or includes cellulose acetate, the currently most common cigarette filter material.

In providing the filter of the present invention with the purine constituent, any manufacturing technique may be used that produces distribution of the purine on the surface of the filtering material, or that enhances exposure of the purine to smoke passing through the filter. For example, the purine material could be distributed on the surface of individual fibers that are combined to form the filter, or after bundling individual fibers together to form the filter, the purine could be distributed onto the filtering material. The latter type of technique is exemplified by the Examples. It is a preferable feature of the present invention that the purine be substantially uniformly distributed on the filtering material, and thus it is preferred that a technique is used that produces substantially uniform distribution of the purine.

In a conventional fibrous tobacco smoke filter, the efficiency of the filter is related to the surface area of the fibers and the linear velocity of the smoke. For example, a typical fibrous filter with a surface area of 275 $cm^2$ has a pressure drop of about 2.8 inches and a filtration efficiency of about 46%. When the surface area of this conventional filter is increased substantially by adding more fibers, the pressure drop of the filter is increased beyond the practical limit. For example, if the surface area of this filter is increased to about 500 $cm^2$ by adding more fibers, the efficiency of the filter is increased to about 66%, but the pressure drop is increased to about 7.5 inches. The filtration coefficient may be calculated from this data by the following equation:

$$k=[-Ln(l-R)]\Delta P,$$

where R represents the filtration efficiency or percent of total particulate matter removed, and Δp is the pressure differential across the filter. The value of k for conventional filters made from textile tows is between 0.13 and 0.22 depending on the size and type of fibers (assuming Δp is expressed in inches of water at an airflow rate of 17.5 ml/sec.).

A conventional filter customarily used commercially in the United States has a filtration surface area and airflow characteristics that provide removal of about 40–45% of the total particulate matter from tobacco smoke. By a conventional filter is meant a filter having substantially uniform density from one end of the filter to the other. This type of filter generally has a total denier of at least 30,000, with an increase in surface area being provided by use of a relatively lower individual fiber denier, for a constant total denier. The filtering materials of the Marlboro and Winston (trademarks for commercial cigarettes) filters used in the Examples that follow are each believed to have a filtration surface area and airflow characteristics that provide removal of about 40–45% of the total particulate matter from tobacco smoke. In this regard, the Marlboro filter is believed to be characterized by about 36,000–42,000 total denier provided by individual fibers of about 3.6–4.2 denier, and characterized by about 5–15% fresh air ventilation.

Another type of filter used commercially in the U.S. is characterized by nonuniform density from one end of the filter to the other. One example of this type of filter, as shown in FIG. 3, has a conically-shaped cavity. Filters of this type are believed to be illustrated by U.S. Pat. No. 4,064,791 to Berger, the filter of which removes 60% or more of the total particulate matter. The disclosure of this prior art patent is hereby incorporated herein by reference. Other filters having a filtration surface area and airflow characteristics that provide removal of at least about 60%, and even up to about 95% of the total particulate matter from tobacco smoke are illustrated by U.S. Pat. Nos. 3,648,711, 3,599,646, and 3,533,416. Each of these patents is hereby incorporated herein by reference. The filtering material of the Vantage (trademark for commercial cigarettes) filter used in the Examples that follow, is believed to have a filtration surface area and airflow characteristics that provide removal of at least about 60% of the total particulate matter.

For purposes of the description contained herein, the percent of total particulate matter removed by the filtering material of the present invention is to be understood to exist when the pressure drop across the filter is about 2.0 to 2.5 inches of water, with up to 3 inches of water being contemplated. A pressure drop greater than about 3.0 is objectionable and not acceptable to the majority of cigarette smokers.

In a specific illustration of the embodiment of the present invention in which the filter is of a size and shape that permits use as a cigarette filter, the purine is caffeine. The size of this cigarette filter is about 19 to 25 mm in length and about 7.8 mm in diameter. The amount of caffeine in this filter is that amount provided by applying about 0.3 ml of an aqueous saturated caffeine solution onto the filtering material of the cigarette filter. The aqueous solution is preferably applied by injection into the approximate midpoint of the filter. The amount of caffeine distributed on the filtering material is about 5–7 mg.

Specific examples of the present invention will now be set forth. It is to be understood that these examples are merely illustrative, and are not in any way to be interpreted as limiting the scope of the invention.

EXAMPLE 1

0.3 ml of an aqueous saturated caffeine solution is injected into the approximate midpoint of a filter removed from a Winston cigarette (King Size) so as to distribute the aqueous solution substantially uniformly throughout the filtering material. The filter has the characteristics shown in Table 1. The treated filter is allowed to dry for 48+ hours while the cigarette tobacco is kept fresh by inserting the tobacco portion of the cigarette into a glass tube and sealing the tube. The dried filter is mounted to the cigarette and completely wrapped with tape, as a result of which any fresh air ventilation effect through the filter wrap is eliminated. The treated filter cigarette is lighted and then "smoked" using timed puffs. The smoke is drawn through the filter and bubbled into 100 ml of pentane solvent. The pentane solvent acts to collect the tars from the smoke. When the cigarette has been "smoked" to within ½–1 cm of the filter, the "smoking" is stopped and the pentane is analyzed using a Perkin-Elmer Model 55B Spectrophotometer at $UV_{\lambda excitation}$ 375+ nm. Data is recorded as absorption with blank at $\lambda_{emission}$ 430 nm. The results are set forth in Table 2.

As a control, 0.3 ml of distilled water is injected into the approximate midpoint of the filter of an identical Winston filter cigarette. The filter is dried and wrapped with tape and "smoked" in an identical manner. In Table 2, the result obtained by analyzing the pentane solvent is provided.

EXAMPLE 2

The procedure of Example 1 is followed for a Vantage filter cigarette having the characteristics set forth in Table 1. Data for the treated Vantage and the control Vantage are set forth in Table 2.

TABLE 1

| | Vantage (Conical Cavity) | Marlboro | Winston |
|---|---|---|---|
| Filter Length (mm) | 25 | 19 | 19 |
| Diameter (mm) | ~7.8 | ~7.8 | ~7.8 |
| Filter Weight (g) | .2696 | .1306 | .1303 |
| Cigarette Length (mm) | 83.5 | 79 | 83.5 |
| Filter Material | cellulose acetate | cellulose acetate | cellulose acetate |
| Filter pH (±0.05) | 5.5 | 5.5 | 5.5 |

TABLE 2

| | Example | Cigarette | Filter | Absorption at λ430 nm |
|---|---|---|---|---|
| Control | 1 | Winston | Winston | 0.048 |

TABLE 2-continued

| | | | | |
|---|---|---|---|---|
| Treated | 1 | Winston | Winston | 0.041 |
| Control | 2 | Vantage | Vantage | 0.059 |
| Treated | 2 | Vantage | Vantage | 0.022 |
| Control | Comparative | Winston | one-half density Winston | 0.060 |
| Treated | Comparative | Winston | one-half density Winston | 0.0595 |
| Control | 3 | Winston | Vantage | 0.047 |
| Treated | 3 | Winston | Vantage | 0.034 |
| Control | 4 | Vantage | Winston | 0.059 |
| Treated | 4 | Vantage | Winston | 0.057 |
| Control | 5 | Vantage | Marlboro | 0.059 |
| Treated | 5 | Vantage | Marlboro | 0.055 |
| | Example | Cigarette | Filter | Response at λ emission 430 nm* |
| Control | 6 | Marlboro | Marlboro | 22.6 |
| Treated | 6 | Marlboro | Marlboro | 21.2 |

*$\lambda_{excitation}$ is 370 nm

COMPARATIVE EXAMPLE

A Winston filter is removed from a Winston filter cigarette of the type used in Example 1. The filter is cut in half lengthwise, and one-half of the filtering material is shredded and packed into a glass tube having an internal diameter of about 7.8 mm to produce a filter having a length of 19 mm. The filter is attached to the filterless tobacco tube portion of the cigarette. Another modified Winston filter cigarette is prepared in like manner, and these modified Winston filter cigarettes are tested in accordance with the procedure of Example 1, except that the cylindrical exterior surface of the filter is not wrapped with tape. In Table 2, data for the treated cigarette and the control cigarette are shown.

EXAMPLE 3

A Vantage filter is removed from a Vantage filter cigarette of the type used in Example 2, and a Winston filter is removed from a Winston filter cigarette of the type used in Example 1. The removed Vantage filter is attached to the filterless Winston cigarette. This procedure is repeated to provide another Winston tobacco blend-Vantage filter cigarette. These modified cigarettes are tested in accordance with the procedure of Example 1, and the results for the treated cigarette and the control cigarette are set forth in Table 2.

As explained earlier, the filtering material of the commercially available Winston filter used in Example 1 is believed to have a filtration surface area and airflow characteristics that provide removal of about 40–45% of the total particulate matter from the smoke, and the filtering material of the Vantage filter used in Examples 2 and 3 is believed to have a filtration surface area and airflow characteristics that provide removal of at least about 60% of the total particulate matter. Furthermore, it is believed that the filtering material of the one-half density Winston filter of the Comparative Example has a filtration surface area and airflow characteristics that provide removal of less than 40–45% of the total particulate matter. In comparing the results of Examples 1 and 3 and of the Comparative Example, the tobacco blend is a constant. Comparison of these particular results is believed to demonstrate that a filter containing a polynuclear aromatic hydrocarbon-reducing amount of a purine and containing a filtering material having a filtration surface area and airflow characteristics that provide removal of about 40–45% of the total particulate matter (Example 1) is remarkably superior to an identical filter that has one-half the density and thus is believed to provide removal of less than 40–45% of the total particulate matter (Comparative Example). Additionally, these results are believed to demonstrate that a filter containing a polynuclear aromatic hydrocarbon-reducing amount of a purine and containing a filtering material having a filtration surface area and airflow characteristics that provide removal of at least about 60% of the total particulate matter (Example 3) is surprisingly superior to a filter containing the same amount of the purine and a filtering material having a filtration surface area and airflow characteristics that provide removal of about 40–45% of the total particulate matter. The ability of the Example 3 type of treated filter to remove a substantially increased amount of polynuclear aromatic hydrocarbons, when compared to the Example 1 type treated filter, is believed clearly unforeseeable when it is noted that the control values for these two filters differ by only 0.001.

EXAMPLE 4

A Vantage filter is removed from a Vantage filter cigarette of the type used in Example 2, and a Winston filter is removed from a Winston filter cigarette of the type used in Example 1. The removed Winston filter is attached to the filterless Vantage cigarette. This procedure is repeated to produce another Vantage tobacco blend-Winston filter cigarette. These modified cigarettes are tested in accordance with the procedure of Example 1, and the results are shown in Table 2.

EXAMPLE 5

A Vantage filter is removed from a Vantage filter cigarette of the type used in Example 2, and a Marlboro filter is removed from a Marlboro filter cigarette having the characteristics shown in Table 1. The removed Marlboro filter is attached to the filterless Vantage cigarette. This procedure is repeated to produce another Vantage tobacco blend-Marlboro filter cigarette. The procedure of Example 1 is followed for these modified cigarettes, and the results for the treated cigarette and the control cigarette are shown in Table 2.

In the next three Examples, it is to be understood that the data is more qualitative than analytical in nature, insofar as, for example, the drying time is not as carefully monitored and the puffs are not timed, although intervals between puffs were timed.

EXAMPLE 6

0.3 ml of an aqueous saturated caffeine solution is injected into the approximate midpoint of the filter from a Marlboro filter cigarette so as to distribute the aqueous solution substantially uniformly throughout the filtering material. The Marlboro filter cigarette used is of the type used in Example 5. The treated filter is rendered dry to the touch by drawing air therethrough for 20–30 minutes using a laboratory vacuum pump. The dried filter is remounted to the tobacco tube and completely wrapped with tape, as a result of which any fresh air ventilation effect is eliminated. The treated filter cigarette is lighted and then "smoked." The smoke is drawn through the filter and bubbled into 100 ml of pentane solvent. The smoke puffs are generated at a lower vacuum than in Examples 1–5. The pentane acts to collect the tars from the smoke. When the cigarette has been "smoked" to within ½–1 cm of the filter, the "smoking" is stopped, and the pentane is analyzed by drawing a fluorescent profile. In Table 2, the peak value is given. This value is found at $\lambda_{emission}$ 430 nm.

As a control, 0.3 ml of distilled water is injected into the approximate midpoint of the filter of an identical Marlboro filter cigarette. The filter is dried and wrapped with tape and the cigarette "smoked" in an identical manner. In Table 2, the value obtained at $\lambda_{emission}$ 430 nm, upon analysis of the pentane solvent, is shown for this control filter.

Comparison of this value for the control filter with the peak value for the treated filter shows that an increase in the amount of the fluorescing material is observed when the filter is treated with the purine. This result is contrary to that expected. Accordingly, it is apparent that experimental error occurred in carrying out this procedure with this particular filter. In the next two examples, data in conformity with that expected are obtained.

EXAMPLE 7

Figure 4:
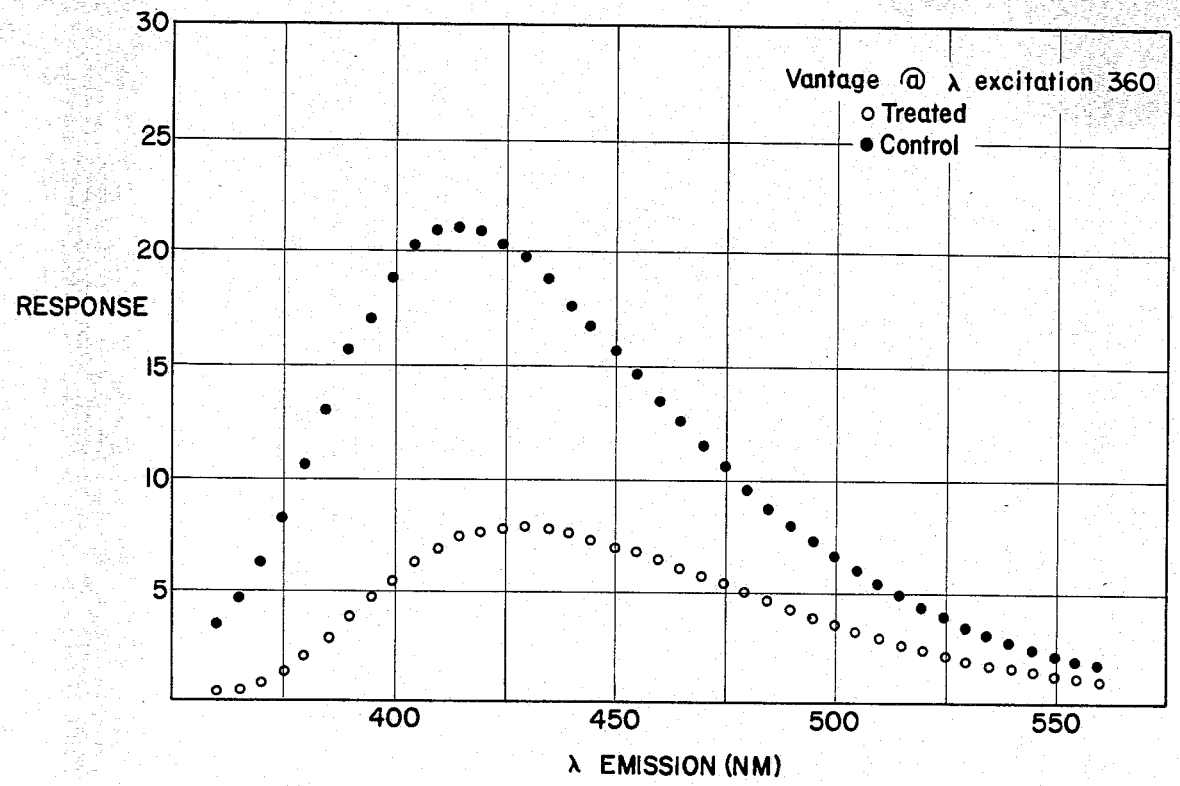
In FIGS. 4 and 5, the fluorescent profiles of certain filters in accordance with the invention are shown.

The procedure of Example 6 is followed for a Vantage filter cigarette of the type used in Example 2. The fluorescent profiles for the treated Vantage cigarette and the control Vantage cigarette are set forth in FIG. 4.

EXAMPLE 8

Figure 5:
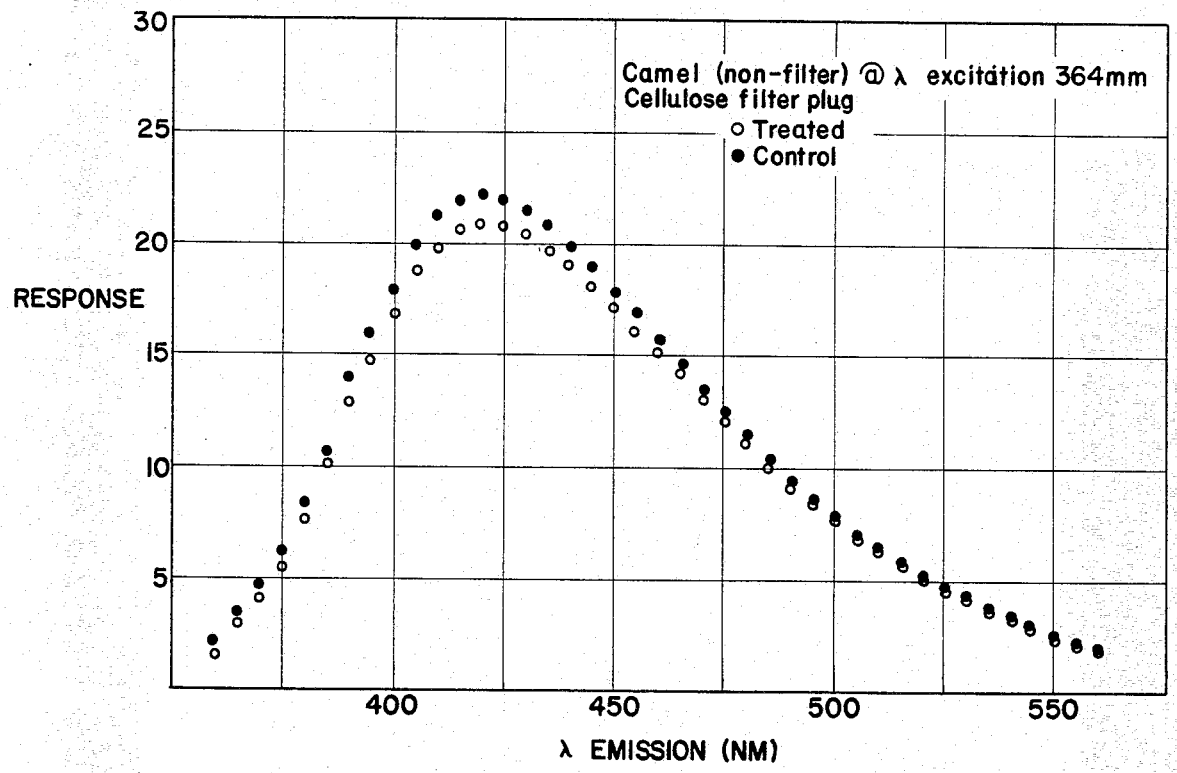

A cellulose filter plug is prepared from a piece of Whatman No. 1 filter paper by cutting the paper into small pieces, boiling the pieces in distilled water until the fibers separate, preparing a paste from the fibers, letting the paste dry, and dry packing the fibers into a hollow glass tube of about 7.8 mm internal diameter to produce a filter having a length and a density that visually approximates that of a commercial filter cigarette. The filter is attached to a Camel cigarette sold commercially without a filter. This procedure is followed to prepare another modified Camel cigarette. The procedure of Example 6 is followed for these modified filter cigarettes, except that the cylindrical exterior surface of the filter is not wrapped with tape, and the fluorescent profiles are shown in FIG. 5.

INDUSTRIAL APPLICABILITY

The filter of this invention is useful for reducing the amount of polynuclear aromatic hydrocarbons in a polynuclear aromatic hydrocarbon-contain gas or smoke. The smoke may be from a variety of sources such as tobacco or the combustion of fuel in an internal combustion engine, particularly a diesel engine. Also, the smoke may result from an industrial pyrolysis process. Thus, the filter of the present invention varies in size and shape depending upon the particular use to which it is put. A particularly valuable use for the filter is as a tobacco smoke filter.

I claim:

1. A filter for a polynuclear aromatic hydrocarbon-containing smoke, said filter comprising (1) a filtering material having a filtration surface area and airflow characteristics that provide removal of at least about 40–45% of the total particulate matter from the smoke, and (2) a polynuclear aromatic hydrocarbon-reducing amount of at least one purine, wherein said at least one purine is distributed on the surface of said filtering material to freely react with the polynuclear aromatic hydrocarbons.

2. The filter of claim 1, wherein said filtering material has a filtration surface area and airflow characteristics that provide removal of at least about 50% of said total particulate matter.

3. The filter of claim 2, wherein said filtering material has a filtration surface area and airflow characteristics that provide removal of about 60–95% of said total particulate matter.

4. The filter of claim 1, wherein said at least one purine is a xanthine.

5. The filter of claim 4, wherein said xanthine is caffeine.

6. The filter of claim 1, wherein said filter is of a size and shape that permits use as a tobacco smoke filter.

7. The filter of claim 6, wherein said amount of said at least one purine is at least about 0.1 mg.

8. The filter of claim 6, wherein said filtering material comprises cellulose acetate.

9. The filter of claim 1, wherein said at least one purine is substantially uniformly distributed on said surface of said filtering material, and wherein the purine distribution is in at least a portion of the available filtration surface area.

10. The filter of claim 9, wherein said purine distribution is throughout said available filtration surface area.

11. The filter of claim 6, wherein said airflow characteristics include venting with diluting air through a wall surrounding the filter material.

12. The filter of claim 1, wherein said filter is of a size and shape that permits coupling to a cigarette for use as a cigarette filter, said size being defined by a length of about 19–25 mm and a diameter of about 7.8 mm; wherein said at least one purine is caffeine; and wherein said amount of caffeine is that amount provided by applying about 0.3 ml of an aqueous saturated caffeine solution onto said filtering material.

13. A filter cigarette having the filter of claim 7.

14. A method for reducing the amount of polynuclear aromatic hydrocarbons in a polynuclear aromatic hydrocarbon-containing smoke, said method comprising passing said smoke through the filter of claim 1.

15. A filter for a polynuclear aromatic hydrocarbon-containing smoke, said filter comprising a filtering material and a polynuclear aromatic hydrocarbon-reducing amount of at least one purine substantially free from tannic acid contamination, said at least one purine being distributed on the surface of said filtering material.

16. The filter of claim 15, wherein said filtering material has a filtration surface area and airflow characteristics that provide removal of at least about 50% of the total particulate matter from the smoke.

17. The filter of claim 16, wherein said filtering material has a filtration surface area and airflow characteristics that provide removal of about 60–95% of said total particulate matter.

18. The filter of claim 15, wherein said at least one purine is a xanthine.

19. The filter of claim 18, wherein said xanthine is caffeine.

20. The filter of claim 15, wherein said filter is of a size and shape that permits use as a tobacco smoke filter.

21. The filter of claim 20, wherein said amount of said at least one purine is at least about 0.1 mg.

22. The filter of claim 21, wherein said amount is approximately equal, on a weight basis, to the tar present in the tobacco being smoked.

23. The filter of claim 20, wherein said filtering material comprises cellulose acetate.

24. The filter of claim 15, wherein said at least one purine is substantially uniformly distributed on said surface of said filtering material, and wherein the purine distribution is in at least a portion of the available filtration surface area.

25. The filter of claim 24, wherein said purine distribution is throughout said available filtration surface area.

26. The filter of claim 20, wherein said filter is of a size and cylindrical shape that permits coupling to a cigarette for use as a cigarette filter, said size being defined by a length of about 19–25 mm and a diameter of about 7.8 mm; wherein said at least one purine is caffeine; and wherein said amount of caffeine is that amount provided by applying about 0.3 ml of an aqueous saturated caffeine solution onto said filtering material.

27. A filter cigarette having the filter of claim 21.

28. A method for reducing the amount of polynuclear aromatic hydrocarbons in a polynuclear aromatic hydrocarbon-containing smoke, said method comprising passing said smoke through the filter of claim 15.

29. A filter in combination with a mechanical or industrial smoke emitter, said filter being for a polynuclear aromatic hydrocarbon-containing smoke, said filter comprising a filtering material and a polynuclear aromatic hydrocarbon-reducing amount of at least one purine, said at least one purine being distributed on the surface of said filtering material to freely react with the polynuclear aromatic hydrocarbons.

30. The filter of claim 29, wherein said at least one purine is a xanthine.

31. The filter of claim 30, wherein said xanthine is caffeine.

32. The filter of claim 29, wherein said at least one purine is substantially uniformly distributed on said surface of said filtering material, and wherein the purine distribution is in at least a portion of the available filtration surface area.

33. The filter of claim 32, wherein said purine distribution is throughout said available filtration surface area.

34. The filter of claim 29, wherein said amount of said at least one purine is an amount sufficient to cover at least about 5% of said surface of said filtering material.

35. A method for reducing the amount of polynuclear aromatic hydrocarbons in a polynuclear aromatic hydrocarbon-containing smoke, said method comprising passing said smoke through the filter of claim 29.

36. A filter cigarette comprising a tobacco tube and a filter connected to one end of said tube, said filter comprising filtering material for removing particulate matter from tobacco smoke passing therethrough, at least one purine distributed on the surface of said filtering material for removing polynuclear aromatic hydrocarbons from smoke passing through the filter, said filter being substantially devoid of other materials which would mask a substantial part of the purine from contact with the smoke or substantially reduce its removal of polynuclear aromatic hydrocarbons from the smoke.

37. A filter cigarette as claimed in claim 36 wherein said purine is caffeine.

38. A filter cigarette as claimed in claim 36 wherein said purine is present in an amount, form and distribution sufficient, together with the filtering material, to remove at least 50% of the polynuclear aromatic hydrocarbons from the smoke passing through the filter.

39. A filter for tobacco smoke comprising a mass of filtering material for removing particulate matter from tobacco smoke passing therethrough, at least one purine distributed on the surface of said filtering material for removing polynuclear aromatic hydrocarbons from smoke passing through the filter, said filter being substantially devoid of other materials which would mask a substantial part of the purine from contact with the smoke or substantially reduce its removal of polynuclear aromatic hydrocarbons from the smoke.

40. A method of making a smoke filter comprising forming filtering material into a porous filter body for passage of smoke, and, before or after formation of the filter body, applying to the filter material a polynuclear aromatic hydrocarbon complexing agent consisting essentially of at least one purine.

41. A method as claimed in claim 40 wherein the purine is applied by applying to the filtering material a solution consisting essentially of at least one purine in a liquid, and drying the filtering material.

42. A method as claimed in claim 41 wherein the solution is a saturated solution of caffeine in a liquid.

43. A method of reducing the carcinogenic hazards of smoke comprising causing the smoke to pass through a porous mass carrying at least one unmasked purine in an amount, form and distribution such that at least 50% of the amount of polynuclear aromatic hydrocarbons in the smoke passing therethrough is removed.

44. A method as claimed in claim 43 wherein the removal percentage is at least 75%.

* * * * *